US009309745B2

(12) United States Patent
Patel

(10) Patent No.: US 9,309,745 B2
(45) Date of Patent: Apr. 12, 2016

(54) INTERVENTIONLESS OPERATION OF DOWNHOLE TOOL

(75) Inventor: Dinesh R. Patel, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 911 days.

(21) Appl. No.: 13/291,447

(22) Filed: Nov. 8, 2011

(65) Prior Publication Data

US 2012/0267119 A1 Oct. 25, 2012

Related U.S. Application Data

(60) Provisional application No. 61/478,257, filed on Apr. 22, 2011.

(51) Int. Cl.
*E21B 34/10* (2006.01)

(52) U.S. Cl.
CPC ..... *E21B 34/10* (2013.01)

(58) Field of Classification Search
CPC ..... E21B 34/10; E21B 34/08; E21B 34/14
USPC ..... 166/317, 319, 320, 373, 374, 375
See application file for complete search history.

(56) References Cited

U.S. PATENT DOCUMENTS

| | | | | |
|---|---|---|---|---|
| 5,810,087 | A | 9/1998 | Patel | |
| 5,950,733 | A | 9/1999 | Patel | |
| 5,992,520 | A * | 11/1999 | Schultz et al. | 166/264 |
| 6,302,216 | B1 | 10/2001 | Patel | |
| 6,684,950 | B2 | 2/2004 | Patel | |
| 7,337,850 | B2 * | 3/2008 | Contant | 166/375 |
| 2005/0224235 | A1 | 10/2005 | Patel | |
| 2007/0227727 | A1 | 10/2007 | Patel et al. | |
| 2008/0128130 | A1 | 6/2008 | Whitsitt et al. | |
| 2009/0242199 | A1 | 10/2009 | Basmajian et al. | |
| 2010/0038092 | A1 * | 2/2010 | Powell et al. | 166/375 |
| 2010/0206579 | A1 | 8/2010 | Guven et al. | |
| 2011/0079382 | A1 | 4/2011 | Patel | |

FOREIGN PATENT DOCUMENTS

| | | | |
|---|---|---|---|
| EP | 232285 | B1 | 2/1991 |
| RU | 2408776 | C1 | 1/2011 |
| SU | 1710703 | A1 | 2/1992 |

* cited by examiner

*Primary Examiner* — David Andrews
*Assistant Examiner* — Kristyn Hall
(74) *Attorney, Agent, or Firm* — David J. Groesbeck

(57) ABSTRACT

A technique facilitates actuation of a downhole tool, such as a valve, in a simple, rapid, and cost-effective manner. The technique comprises installing the downhole tool with a trip saver. The trip saver can be actuated by increasing a tubing pressure or other suitable pressure source beyond a threshold level. Once the trip saver is actuated, a fluid under suitable pressure is provided to a downhole tool through a passageway opened via the trip saver. This enables actuation of the downhole tool to a desired state.

15 Claims, 8 Drawing Sheets

INTERVENTIONLESS OPERATION OF DOWNHOLE TOOL

CROSS-REFERENCE TO RELATED APPLICATION

The present document is based on and claims priority to U.S. Provisional Application Ser. No. 61/478,257 filed Apr. 22, 2011, incorporated herein by reference.

BACKGROUND

Hydrocarbon fluids, e.g. oil and natural gas, are obtained from a subterranean geologic formation, referred to as a reservoir, by drilling a well that penetrates the hydrocarbon-bearing formation. Once a wellbore is drilled, various forms of well completion components may be installed to control and enhance the efficiency of producing fluids from the reservoir. In some applications, for example, a formation isolation valve (FIV) may be used to isolate the formation or portions of the formation. Such a valve may be run in a sand face completion.

Formation isolation valves generally are actuated to a closed position with a shifting tool after run-in of a sand face completion and then opened through a subsequent operation, e.g. an intervention operation. In some applications the subsequent operation may be an interventionless operation, but existing interventionless operations are relatively time-consuming and expensive. For example, certain existing systems enable opening of the formation isolation valve via tubing pressure cycles with liquid in the tubing. Generally, the density of the fluid above the closed valve is such that the hydrostatic pressure of the fluid column above the closed valve is lower than the formation pressure below the valve. This is done to allow the information to flow naturally after the valve is opened to put the well on production. However, in a well drilled and completed in a depleted formation the formation pressure below the valve may be lower than the hydrostatic pressure from the fluid column above the valve. To allow the well to start production in this type of situation, the fluid column above the closed valve is displaced partially or fully with nitrogen gas. After the valve is opened, the gas pressure is bled off to reduce the pressure to a level below the formation pressure so the well can start flowing. However, the nitrogen in the tubing can inhibit the effectiveness of the cycles and also can require substantial amounts of time to open the formation isolation valve.

SUMMARY

In general, the present disclosure provides a technique for actuating a downhole tool, such as a valve, in a simple, rapid, and cost-effective manner. The technique comprises installing the downhole tool with a trip saver. The trip saver can be actuated by increasing a pressure, e.g. a tubing pressure, beyond a threshold level. Once the trip saver is actuated, a fluid under suitable pressure is provided to a downhole tool through a passageway opened via the trip saver. This enables actuation of the downhole tool, e.g. valve, to a desired state.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate only the various implementations described herein and are not meant to limit the scope of various technologies described herein, and.

DETAILED DESCRIPTION

In the following description, numerous details are set forth to provide an understanding of some illustrative embodiments of the present disclosure. However, it will be understood by those of ordinary skill in the art that the present disclosure may be practiced without these details and that numerous variations or modifications from the described embodiments may be possible.

The disclosure herein generally relates to well completion installation systems, and more particularly to a completion system comprising a downhole tool, e.g. a formation isolation valve, having an actuator that is operable via a rupture member, e.g. a rupture disc. Various embodiments of the concepts presented herein may be applied to a wide range of applications and fields, including many types of downhole applications.

Figure 1:
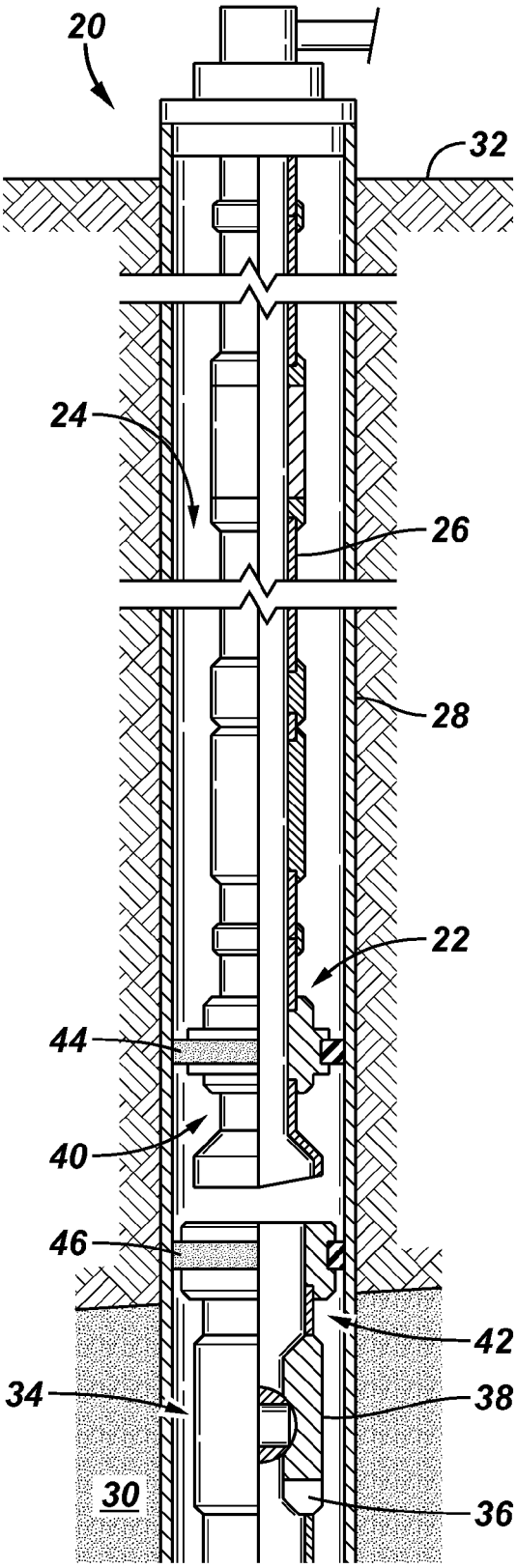
FIG. 1 is a partial cross-sectional illustration of a completion system including a valve with a trip saver module, according to an embodiment of the disclosure.

Referring generally to FIG. 1, an embodiment of a well system 20 is illustrated as comprising a completion 22 deployed in a wellbore 24 via tubing 26, e.g. production tubing or coiled tubing. Completion 22 may include a wide variety of components, depending in part on the specific application, geological characteristics, and well type. In the example illustrated, the wellbore 24 is substantially vertical and lined with a casing 28. However, various embodiments of completion 22 may be used in a well system having many types of wellbores, including deviated, e.g. horizontal, single bore, multilateral, single zone, multi-zone, cased, uncased (open bore), or other types of wellbores.

The illustrated completion 22 is designed to facilitate production of a desired fluid, e.g. a hydrocarbon-based fluid, from a formation 30 surrounding the wellbore 24 to a surface 32. The completion 22 comprises a downhole tool 34 which may be actuated without intervention via the aid of a trip saver module 36 which is a remote operation module. In the specific example illustrated, downhole tool 34 comprises a valve 38, e.g. a formation isolation valve, constructed with trip saver module 36. However, completion 22 may comprise many other types of components, including additional formation isolation valves 38.

By way of example, the completion 22 may comprise an upper completion 40 and a lower completion 42 although some applications utilize a combined, single trip completion. The upper completion 40 may comprise a packer 44 and tubing 26 as well as a variety of other components, including sensors and valves, e.g. flow control valves and safety valves. The specific selection of components depends on the application of overall well system 20. Similarly, the lower completion 42 may comprise many types of components, such as a screen hangar packer 46 and valve 38 with trip saver module 36. The lower completion 42 also may include a variety of other components, including screens, inflow control devices, additional formation isolation valves, additional packers, sensors, and other components, depending on the specific application of overall well system 20. In this example, the lower completion 42 is initially run in hole prior to running of the upper completion 40 downhole into engagement with the lower completion 42.

Figure 2:
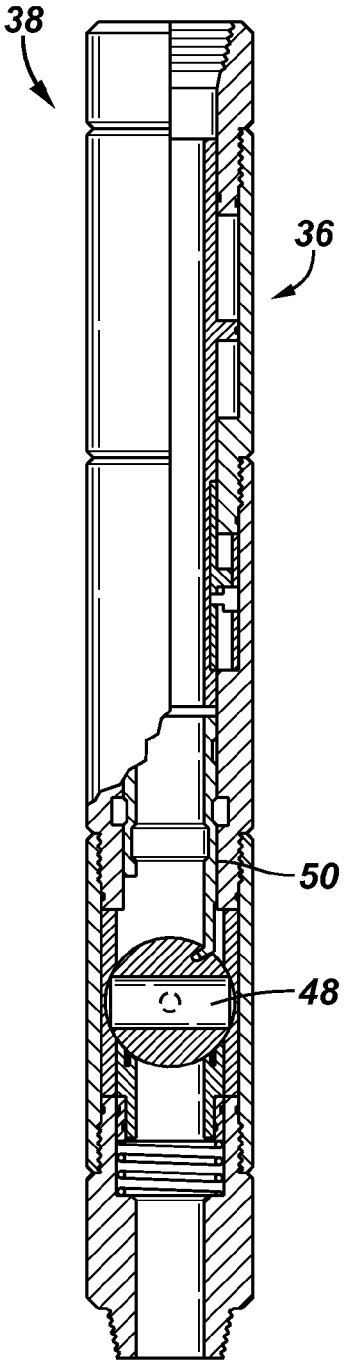
FIG. 2 is a partial cross-sectional illustration of a valve with trip saver module, according to an embodiment of the disclosure.

Referring generally to FIG. 2, a partial cross-sectional sectional enlargement of the valve 38, along with its trip saver module 36, is illustrated. In this example, the valve 38 comprises a valve member 48 operated by an actuator 50 coupled to the trip saver module 36. The valve member 48 is illustrated as a ball valve type of valve element, but other types of valve elements, e.g. sliding sleeves, can be used in valve 38. The trip saver module 36 is configured to remotely open the valve 38 in response to signals sent from the surface 32 of the well system 20.

One form of signals may comprise changes in pressure delivered downhole through, for example, tubing 26. The changes in pressure may be increases in pressure or decreases in pressure, i.e. bleeding off pressure. In some applications, the pressure signals may comprise various cycles of increased and decreased tubing pressure. In other applications, the signals may comprise changes in tubing pressure corresponding to timing, e.g. set patterns of signals, specific frequency signals, or patterns of spacing between pressure pulses. The signals also may comprise changes in tubing pressure corresponding to magnitude, e.g. set patterns of signal pressure magnitudes or specific levels of pressure changes. Upon receiving a single pressure pulse of sufficient magnitude, for example, the trip saver module 36 may be actuated to open the valve 38, e.g. a formation isolation valve, via actuator 50. However, other types of signals, e.g. electric signals, also may be used and delivered downhole to, for example, an electronic trigger device.

Figure 3:
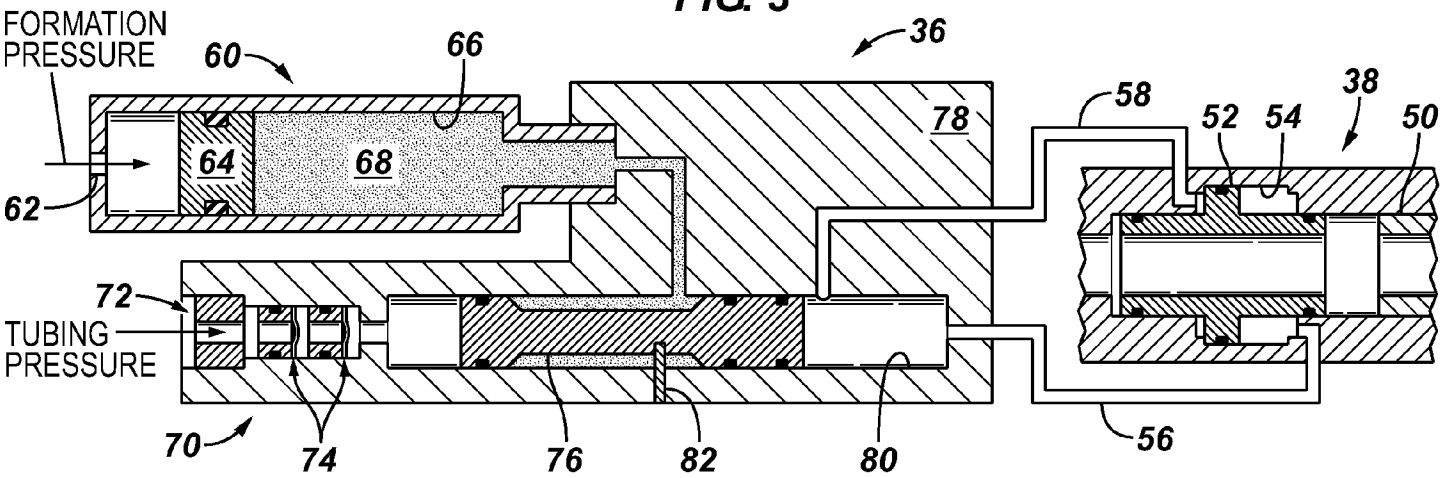
FIG. 3 is a schematic illustration of the operation of a valve and trip saver module configured to open upon pressuring up the tubing, according to an embodiment of the disclosure.
Figure 4:
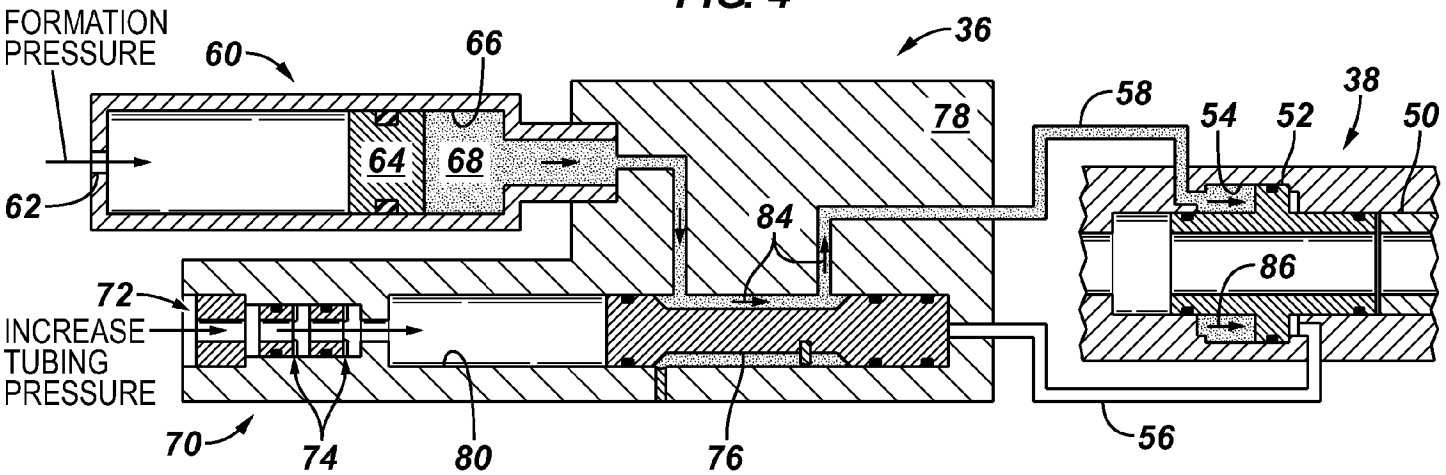
FIG. 4 is a schematic illustration similar to that of FIG. 3 but in a different operational position, according to an embodiment of the disclosure.

Referring generally to FIGS. 3 and 4, a schematic illustration is provided of an example of a valve 38 comprising an embodiment of trip saver module 36. In this example, the valve member 48 of valve 38 is operated by actuator 50 which comprises a piston 52 slidably received in a chamber or cylinder 54. The chambers of cylinder 54 on both sides of the piston 52 are at atmospheric pressure. Those atmospheric chambers acting on opposite sides of piston 52 are in communication with each other via hydraulic lines 56, 58 and a chamber 80. A pressure increase in the atmospheric chambers, e.g. due to seal damage, is the same on both sides of the piston 52 to prevent accidental opening or actuating of the valve 38. The piston 52 may be driven back and forth by a hydraulic pressure applied through hydraulic lines 56, 58, respectively. The hydraulic lines 56, 58 are coupled with the trip saver module 36 of valve 38.

In the embodiment illustrated, trip saver module 36 comprises an actuation component 60 coupled to formation pressure via, for example, a passageway 62. The actuation component 60 may comprise a compensating piston 64 and a liquid chamber 66, e.g. an oil chamber, filled with a suitable liquid 68, e.g. oil. The trip saver module 36 further comprises a trip saver component 70 coupled to tubing pressure via, for example, a passageway 72. The tubing pressure is directed down through tubing 26. It should be noted that the different pressures, e.g. first and second pressures, acting on actuation component 60 and on trip saver component 70 may be created at different pressure regions along wellbore 24. The pressure also may be directed downhole along various combinations of regions internal and external to tubing 26. The trip saver component 70 may comprise at least one rupture member 74 and a pressure isolation piston 76 slidably retained within, for example, a valve block 78. In some embodiments, a plug having seals can be held in position with a shear member, e.g. shear pins, and can be used in place of the rupture disc. Initially, the pressure isolation piston 76 may be retained at a predetermined position within the chamber or cylinder 80 of valve block 78 by a shear member 82, such as a shear pin. In the specific example illustrated, the trip saver component 70 utilizes a pair of rupture members 74 in the form of rupture discs.

FIG. 3 illustrates valve 38 and its trip saver module 36 in an initial state prior to rupturing of rupture members 74. In this state, actuating component 60 is coupled to formation pressure through passageway 62 via compensating piston 64 and oil chamber 66. The compensating piston 64 and oil chamber 66 help prevent contamination of the operating fluid 68, e.g. hydraulic fluid, used to actuate valve 38.

When sufficient pressure is applied through the tubing 26 or through another suitable passage, the pressure threshold of rupture discs 74 is exceeded and the rupture discs are burst. This allows the tubing pressure to operatively interact with pressure isolation piston 76, as illustrated in FIG. 4. The pressure shifts pressure isolation piston 76 to the right, as illustrated in FIG. 4, and shears the shear member 82. After shearing the shear member 82, pressure isolation piston 76 continues to shift within the valve block 78 until fluid communication is established between oil chamber 66 and one side of piston 52 of actuator 50, as represented by arrows 84. The formation pressure moves compensating piston 64 and forces fluid 68 through valve block 78 and along hydraulic line 58 to shift piston 52 and actuator 50, as represented by arrows 86.

As a result of the fluid communication into chamber 54 under formation pressure, the formation isolation valve 38 is actuated via actuator 50 to, for example, an open position. Opening the valve member 48 of valve 38 establishes fluid communication between formation 30 and production tubing 26. Although the compensating piston 64 is illustrated as reacting to formation pressure to actuate the valve 38, other forces may be employed to actuate the valve 38 once the threshold pressure of the tubing 26/rupture discs 74 is passed. In some cases, for example, resilient force devices such as mechanical or gas springs may be used to move the compensating piston 64 once the pressure isolation piston 76 is translated from its initial position. The actuation component 60 and the pressure isolation piston 76 provide a primary and secondary redundancy to ensure proper actuation of tool 34. However, various types of similar or dissimilar devices can be used to provide the desired actuation and/or redundancy. It should be noted that two or more similar devices, e.g. two pressure isolation piston 76, may be used in a variety of ways to provide primary and secondary actuation mechanisms for redundancy. For example, a pair of pressure isolation pistons 76 may be used in which one of the pressure isolation pistons is coupled to a rupture disc and the other pressure isolation piston is coupled to an electronic trigger device. The electronic trigger device is designed to move the other pressure isolation piston 76 upon receipt of a predetermined signal transmitted downhole.

Figure 5:
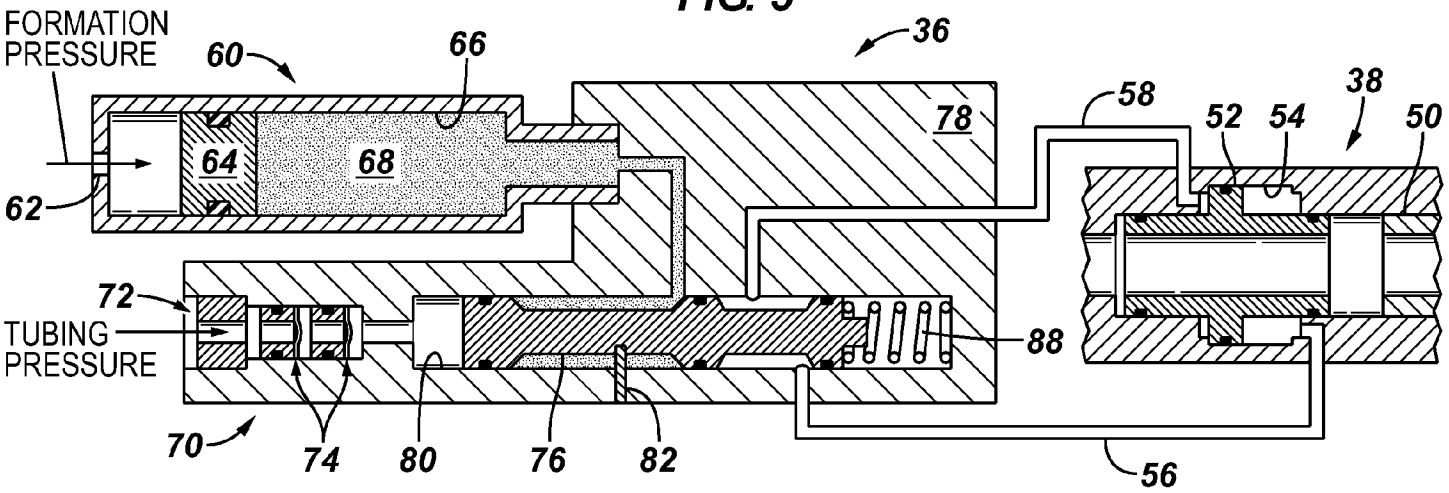
FIG. 5 is a schematic illustration of the operation of a valve and trip saver module configured to open upon pressure bleed off of the tubing, according to an embodiment of the disclosure.
Figure 6:
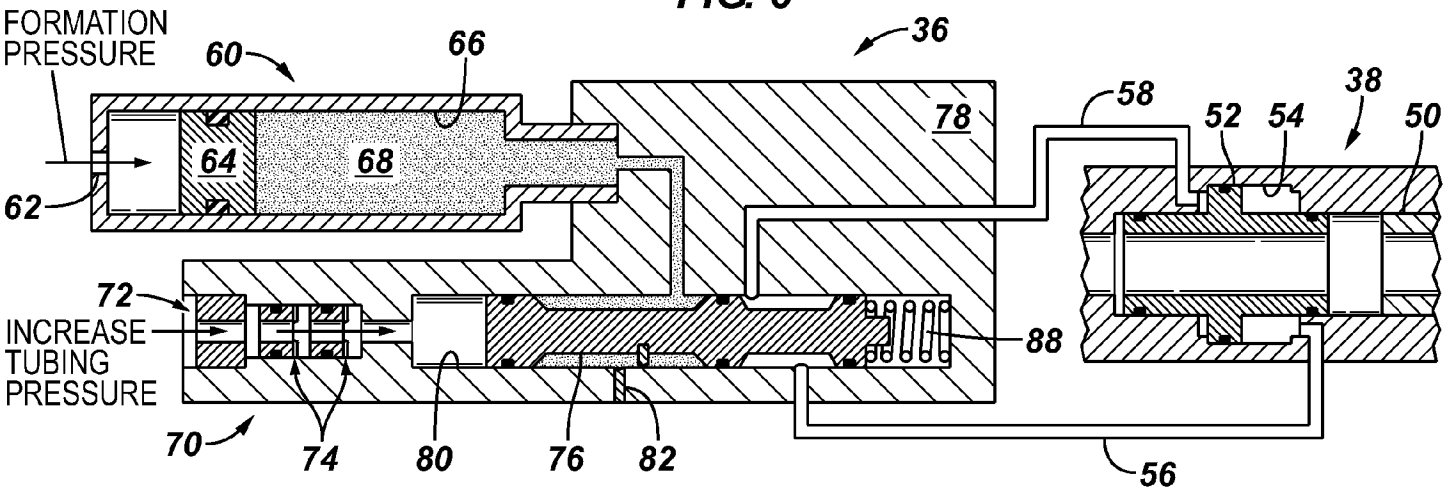
FIG. 6 is a schematic illustration similar to that of FIG. 5 but in a different operational position, according to an embodiment of the disclosure.
Figure 7:
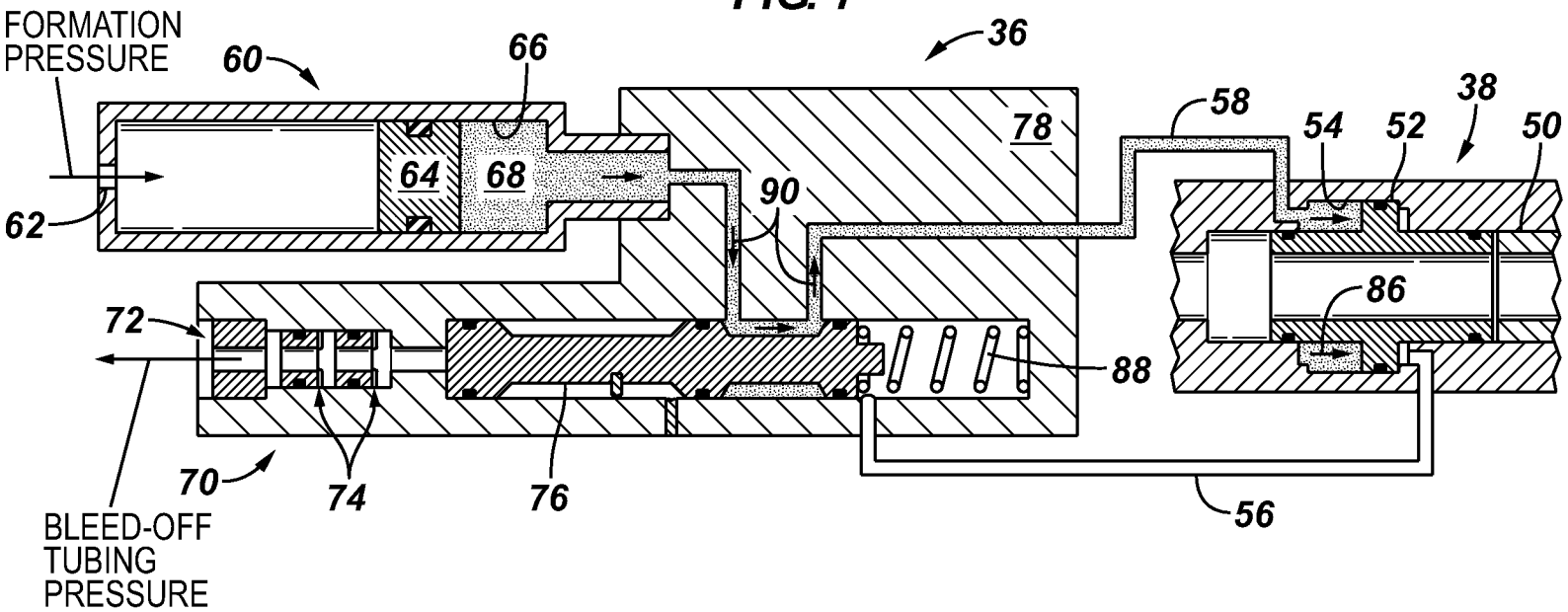
FIG. 7 is a schematic illustration of the operation of a valve and trip saver module configured to open upon pressure bleed off of the tubing and showing the actuation of the valve, according to an embodiment of the disclosure.

Referring generally to FIGS. 5-7, another embodiment of the valve 38 and its trip saver module 36 is illustrated. In this embodiment, the trip saver module 36 is designed to actuate the valve 38 to, for example, an open flow position when pressure is bled off within tubing 26. It should be noted that many of the components described below are similar to or the same as components described in the embodiment illustrated in FIGS. 3-4, and those components have been labeled throughout this description with the same reference numerals.

As illustrated in FIG. 5, one or more rupture discs 74 again initially block tubing pressure from reaching pressure isolation piston 76, and pressure isolation piston 76 is held in place by shear member 82. Upon reaching and/or passing the threshold tubing pressure, the one or more rupture discs 74 in the valve block 78 are burst, thus allowing the tubing pressure to exert a force against the pressure isolation piston 76. The tubing pressure is at a sufficient level to break shear member 82, thus allowing an initial movement of pressure isolation piston 76 to the right, as illustrated in FIG. 6. However, this initial movement of the pressure isolation piston does not establish a communicative fluid pathway between the oil chamber 66 and one side of piston 52 of actuator 50.

The pressure isolation piston 76 remains at this position until a bleed off of tubing pressure occurs. As the tubing pressure is bled off, a resilient member 88, e.g. a spring or other form of resilient device, biases the pressure isolation piston 76 in an opposite, e.g. leftward, direction, as illustrated in FIG. 7. The pressure isolation piston 76 continues to translate in this opposite direction within the valve block 78 until a fluid pathway is established between the oil chamber 66 and one side of piston 52, as represented by arrows 90. Consequently, the actuator 50 is moved to open (or otherwise actuate) the valve 38 under the pressure of liquid 68. Liquid 68 is again acted on by compensating piston 64 which moves as a result of the formation pressure or other suitable pressure. One advantage of such a system is that tubing pressure is removed from one side of the valve 38 prior to opening the valve. This provides the ability to prevent or inhibit a fluid shock from being delivered to the formation upon the opening of the valve 38.

Figure 8:
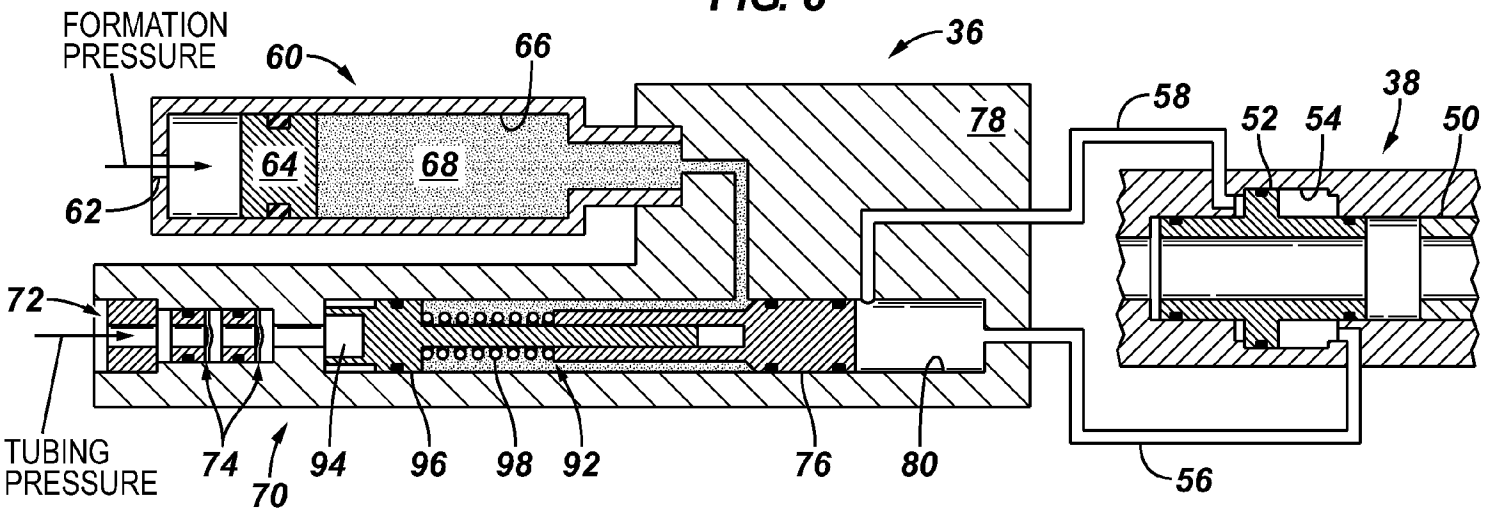
FIG. 8 is a schematic illustration of the operation of a valve and trip saver module configured to use an indexing trigger device set to actuate upon a predetermined number of tubing pressure cycles, according to an embodiment of the disclosure.
Figure 9:
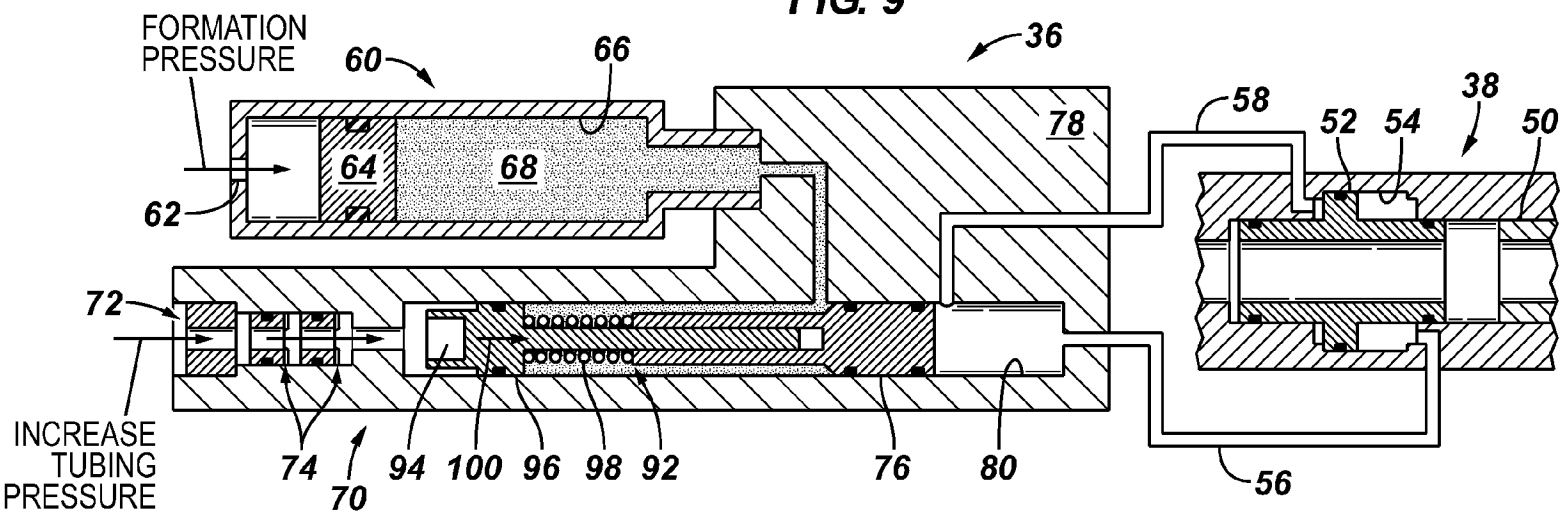
FIG. 9 is a schematic illustration similar to that of FIG. 8 but in a different operational position, according to an embodiment of the disclosure.
Figure 10:
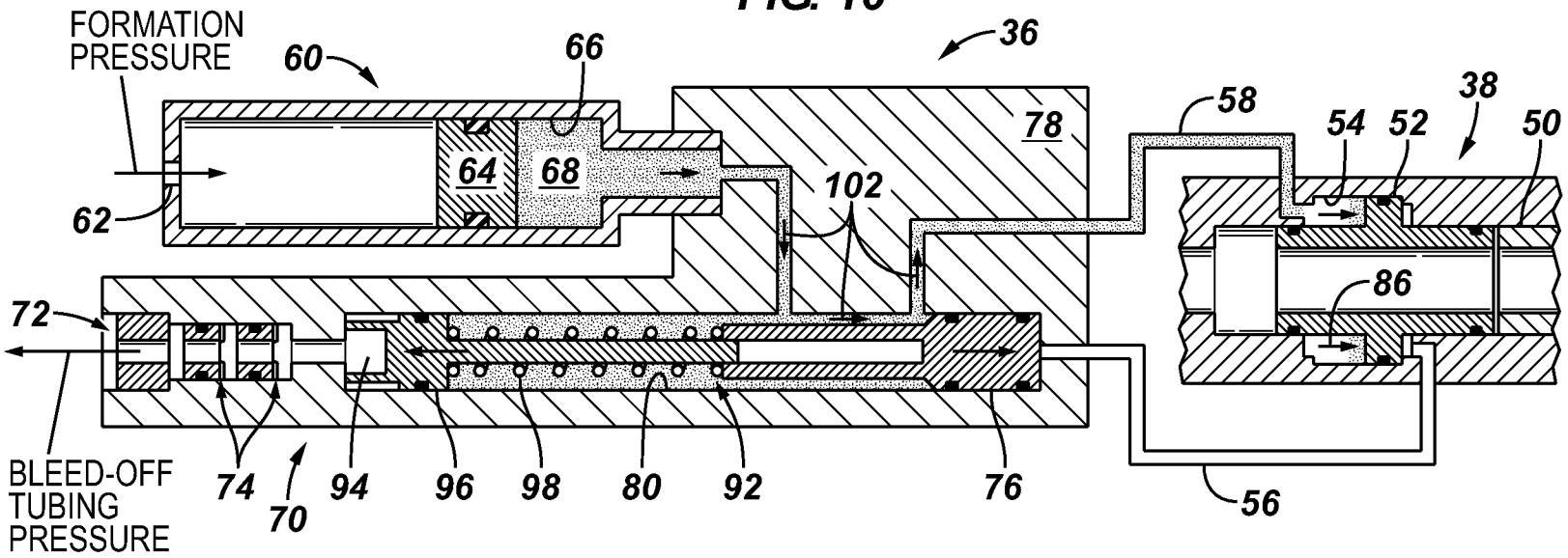
FIG. 10 is a schematic illustration of the operation of a valve and trip saver module configured to use an indexing trigger device set to actuate upon a predetermined number of tubing pressure cycles and showing the actuation of the valve, according to an embodiment of the disclosure.

Referring generally to FIGS. 8-10, another embodiment of the valve 38 and its trip saver module 36 is illustrated. In this embodiment, the trip saver module 36 is designed to utilize an indexing trigger device 92 which is set to actuate upon a predetermined number of tubing pressure cycles. In the illustrated example, the indexing trigger device 92 is part of trip saver component 70 and is exposed to tubing pressure via passageway 72. The indexing trigger device 92 may be used to initially hold pressure isolation piston 76 instead of using shear member 82, as illustrated in FIG. 8.

FIG. 8 illustrates valve 38 and its trip saver module 36 in an initial state prior to rupturing of rupture members 74. In this state, actuating component 60 is coupled to formation pressure through passageway 62 via compensating piston 64 and oil chamber 66. When sufficient pressure is applied through the tubing 26 or through another suitable passage, the pressure threshold of rupture discs 74 is exceeded and the rupture discs are burst. This allows the tubing pressure to operatively interact with indexing trigger device 92. Consequently, translation of the pressure isolation piston 76 to move the actuator 50 occurs after first increasing pressure to a certain threshold level followed by a series of low pressure cycles directed through tubing coupled to the well completion.

The indexing trigger device 92 may be constructed in a variety of forms and may comprise, for example, J-slots through which the device transitions upon successive increases and decreases of pressure in tubing 26. In some applications, the indexing trigger device 92 may be similar to a device described and published in US Patent Publication US2009/02421999A1 entitled "Systems and Techniques to Actuate Isolation Valves". However, the indexing trigger device may comprise a variety of components 94, 96, 98 to achieve desired functions. By way of example, component 96 may comprise an indexing piston mechanism acting against a spring member 98. In the embodiment illustrated, the right side of indexing piston mechanism 96 is in communication with the oil chamber 66 and thus with formation pressure.

After the initial bursting of the rupture discs 74, the tubing pressure may be cycled relative to the formation pressure to cause back and forth translation of the indexing piston mechanism 96 of indexing trigger device 92, as represented by arrow 100 in FIG. 9. As the indexing piston mechanism 96 is translated, pins (not shown) may travel along a pathway, e.g. a J-slot pathway, counting the number of relative pressure cycles. When the predetermined number of pressure cycles is reached, a longer slot or pathway, e.g. a longer J-slot, is accessed to permit the rightward movement of the indexing piston mechanism 96. The rightward movement causes a corresponding movement of pressure isolation piston 76, as illustrated in FIG. 10. After shifting pressure isolation piston 76, fluid communication is established between oil chamber 66 and one side of piston 52 of actuator 50, as represented by arrows 102. The formation pressure moves compensating piston 64 and forces fluid 68 through valve block 78 and along hydraulic line 58 to shift piston 52 and actuator 50, as represented by arrows 86.

As a result of the fluid communication into chamber 54 under formation pressure, the valve 38 is actuated via actuator 50 to, for example, an open position. Opening the valve member 48 of valve 38 again establishes fluid communication between formation 30 and production tubing 26. When using the indexing trigger device 92, the cycle count of the indexing system may be isolated from random fluctuations of tubing pressure during completion operations and other well related operations. Only after application of the threshold pressure to break rupture discs 74 is the indexing trigger device 92 able to react to tubing pressure cycles.

Figure 11:
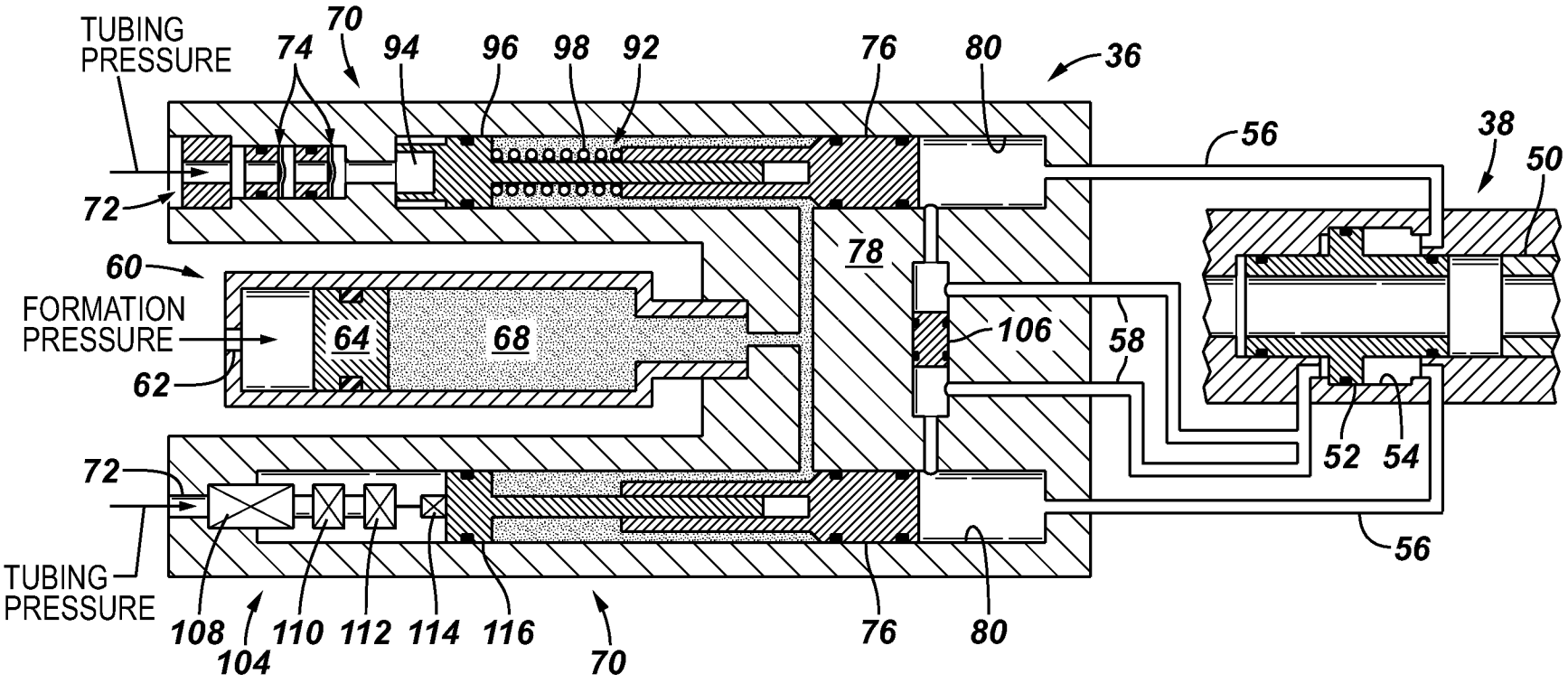
FIG. 11 is a schematic illustration of the operation of a valve and trip saver module configured to use either an indexing trigger device set to actuate upon a predetermined number of tubing pressure cycles or an electronic trigger device set to actuate upon a tubing pressure signal, according to an embodiment of the disclosure.
Figure 12:
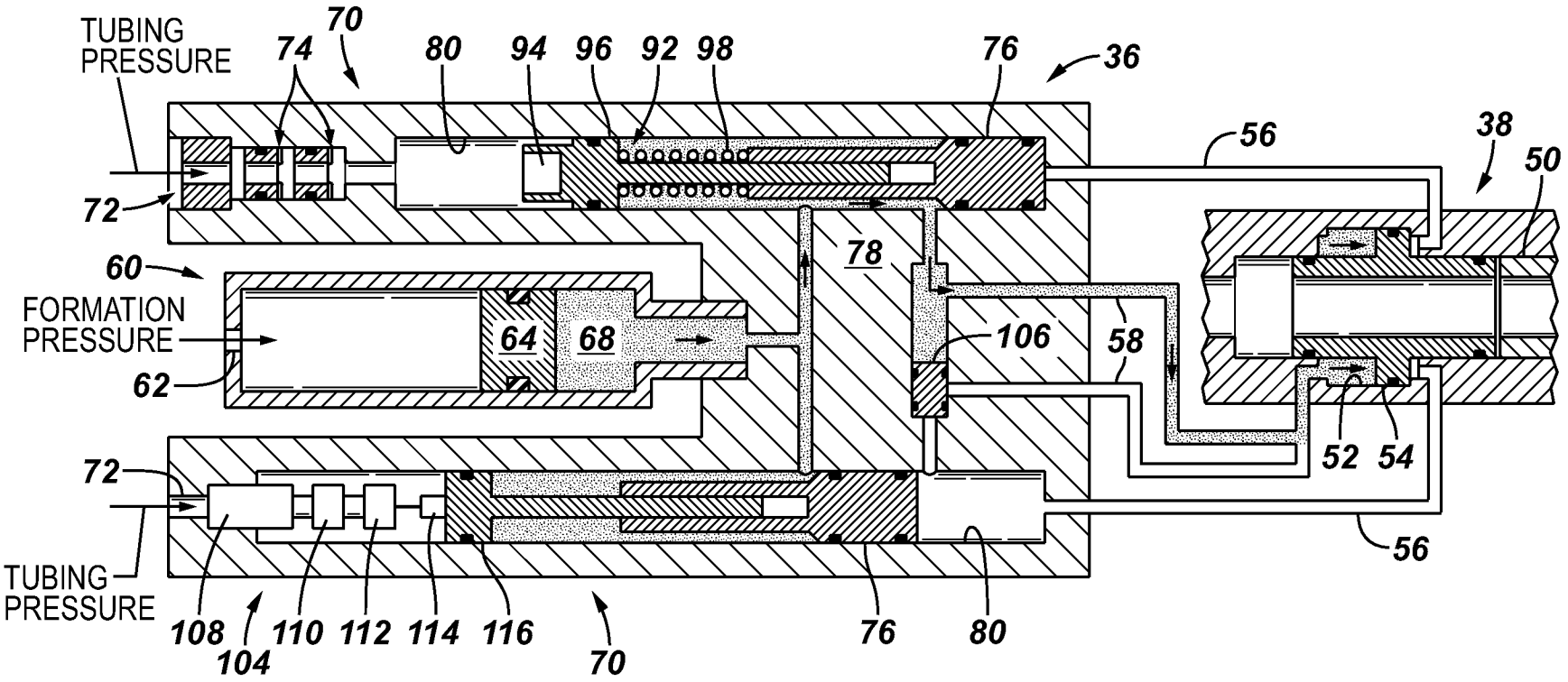
FIG. 12 is a schematic illustration of the operation of a valve and trip saver module configured to use either an indexing trigger device set to actuate upon a predetermined number of tubing pressure cycles or an electronic trigger device set to actuate upon a tubing pressure signal and showing the actuation of the valve due to the indexing trigger device, according to an embodiment of the disclosure.

Referring generally to FIGS. 11 and 12, another embodiment of the valve 38 is illustrated. In this example, the trip saver module 36 comprises an embodiment of the trip saver component 70 having both the indexing trigger device 92 and an electronic trigger device 104. The indexing trigger device 92 and the electronic trigger device 104 provide redundancy and each system cooperates with its own pressure isolation piston 76. For example, the system may be designed to actuate the valve 38 based on either the indexing trigger device 92, set to actuate upon a predetermined number of tubing pressure cycles, or the electronic trigger device 104, set to actuate upon a tubing pressure signal.

The indexing trigger device 92 may be designed to operate in a manner similar to that described above with reference to FIGS. 8-10. Upon actuation of the indexing trigger device 92 from its initial position (illustrated in FIG. 11) to its rightmost position (illustrated in FIG. 12), liquid from liquid chamber 66 moves a shuttle piston 106 to a position which isolates the lower portion of the valve block 78 containing electronic trigger device 104 and its corresponding pressure isolation piston 76. This allows the portion of trip saver component 70 containing indexing trigger device 92 to control movement of actuator 50 and actuation of valve 38.

However, in the event of failure of the indexing trigger device 92 or if the tubing pressure cannot reach the necessary threshold level, the electronic trigger device 104 may be used to actuate the valve 38. It should be noted that electronic trigger device 104 also can be used on its own or as the primary trip saver device in trip saver component 70 instead of serving as a redundant system. Regardless, the electronic trigger device 104 may be designed to use a pressure sensor 108 which detects the sending of a predetermined signal via tubing pressure within tubing 26. The signal may comprise time-based, magnitude-based, or other suitable signals detectable by the electronic trigger device 104.

The design of electronic trigger device 104 may vary depending on the parameters of a given application. According to one example, the electronic trigger device 104 comprises a power source 110 which may be in the form of a battery or other storage device. The power source 110 also may be in the form of supplied power or generated power. The electronic trigger device 104 may further comprise electronics 112, coupled to power source 110, and an actuator 114 designed to translate a piston 116 or another suitable component against pressure isolation piston 76. By way of example, the actuator 114 may comprise a motor, a hydroelectric pump, a screw system, a solenoid, or another suitable type of actuator.

Upon receipt of the predetermined signal by sensor 108, the electronics 112 control operation of actuator 114 to move piston 116 against pressure isolation piston 76. As a result, the pressure isolation piston 76 is shifted in the rightward direction via electronic trigger device 104. Consequently, shuttle piston 106 is shifted in an opposite direction and fluid communication is established between oil chamber 66 and one side of piston 52. The formation pressure moves compensating piston 64 and forces fluid 68 through valve block 78 and along the appropriate hydraulic line to shift piston 52 and actuator 50. As with the indexing trigger device 92, this movement of actuator 50 transitions the valve 38 to a desired flow position, such as an open flow position enabling flow from formation 30 into tubing 26.

The various embodiments of the valve 38 and its trip saver module 36 may be used in many types of applications and environments. In one example, the lower completion 42 is initially run downhole with sand screens. To provide access to formation 30, the casing 28 proximate the desired portion of formation 30 is perforated. As the wash pipe is pulled-out-of-hole, a shifting tool at the end of the wash pipe is used to close the one or more valves 38, thus isolating the formation 30 from the surface of the well.

This enables installation of the upper completion 40 without having to deal with fluids flowing from the formation 30. After the upper completion 40 is installed, an operator is able to easily and selectively open the one or more valves 38 to begin production of the well without having to go through the time, trouble and expense of an intervention. The trip saver module(s) 36 provides the ability to open the formation isolation valve(s) remotely through the use of tubing pressure via one or more of the methodologies and systems described herein.

The components of valve 38 and of overall well system 20 can be adjusted to accommodate a variety of structural, operational, and/or environmental parameters. For example, various combinations of completion components may be employed in constructing lower completions, upper completions, or combined, single completions. Additionally, the specific components and arrangements of components within the trip saver module and in the overall formation isolation valve may be modified to accommodate a wide variety of applications and environments. Furthermore, the components described above provide for may be combined to provide two types of actuating mechanisms arranged as a primary and a secondary actuator for providing redundancy. The two actuating mechanisms may be the same type of device or two different types of devices. Other combinations of components also may be employed. In some applications, for example, a rupture disc is coupled to one of the pressure isolation pistons of the pair of pressure isolation pistons and an electronic trigger device is coupled to the other pressure isolation piston of the pair of pressure isolation pistons. The electronic trigger device moves the other pressure isolation piston upon receipt of a predetermined signal transmitted downhole.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A valve system, comprising:

an actuation component coupled to formation pressure and comprising:

a compensating piston; and an oil chamber;

a trip saver component coupled to tubing pressure and comprising:

one or more rupture discs configured to burst upon reaching a threshold pressure; and a pressure isolation piston within a chamber of a valve block and temporarily retained via a shear member; and an actuator comprising an operating piston fluidly coupled to the valve block by a pair of communication lines which extend from opposite sides of the operating piston, respectively, to the chamber to prevent accidental actuation of the actuator; wherein after the tubing pressure reaches the threshold pressure, the one or more rupture discs are burst, translating the pressure isolation piston within the valve block, shearing the shear member, and establishing communication between the oil chamber and the actuator to actuate a device to a desired state.

2. The valve system as recited in claim 1, further comprising a well completion in which the device is positioned to control fluid flow through the well completion.

3. The valve system as recited in claim 2, wherein translating the pressure isolation piston to move the actuator occurs after a series of pressure cycles directed through a tubing coupled to the well completion.

4. The valve system as recited in claim 2, wherein translating the pressure isolation piston to move the actuator occurs after increasing pressure to a certain threshold followed by a series of lower pressure cycles directed through a tubing coupled to the well completion.

5. The valve system as recited in claim 1, wherein translating the pressure isolation piston to move the actuator occurs during application of increased pressure on the pressure isolation piston.

6. The valve system as recited in claim 1, wherein translating the pressure isolation piston to move the actuator occurs during bleeding off of pressure on the pressure isolation piston.

7. The valve system as recited in claim 1, further comprising an indexing device coupled to the pressure isolation piston.

8. The valve system as recited in claim 1, wherein the pressure isolation piston comprises a pair of pressure isolation pistons.

9. The valve system as recited in claim 8, further comprising an indexing device coupled to one of the pressure isolation pistons of the pair of pressure isolation pistons and an electronic trigger device coupled to the other pressure isolation piston of the pair of pressure isolation pistons, the electronic trigger device moving the other pressure isolation piston upon receipt of a predetermined signal transmitted downhole.

10. A method of downhole actuation, comprising:

providing an actuation component with a compensating piston acting against a liquid in a liquid chamber;

forming a trip saver component with a rupture member and a pressure isolation piston slidably positioned in a pressure isolation piston chamber;

exposing the compensating piston to a first wellbore region subjected to pressure and exposing the rupture member to a second wellbore region subjected to pressure;

providing a flow path through the pressure isolation piston chamber between the liquid chamber and an actuator of a downhole tool; and using the pressure isolation piston to selectively block flow of the liquid or enable flow of the liquid along the flow path through the pressure isolation piston chamber and against the actuator of the downhole tool.

11. The method as recited in claim 10, further comprising rupturing the rupture member by applying fluid pressure in the second wellbore region above a predetermined pressure threshold.

12. The method as recited in claim 10, further comprising using a second type of trip saver component to provide primary and secondary redundancy.

13. The method as recited in claim 10, further comprising using a second trip saver component of the same type as the trip saver component to provide primary and secondary redundancy.

14. The method as recited in claim 10, further comprising coupling the pressure isolation piston to a rupture disc and coupling a second pressure isolation piston to an electronic trigger device in which the electronic trigger device moves the second pressure isolation piston upon receipt of a predetermined signal transmitted downhole.

15. The method as recited in claim 10, further comprising controlling shifting of the pressure isolation piston with an indexing device.

* * * * *